US007140478B2

(12) United States Patent
Barvosa-Carter et al.

(10) Patent No.: US 7,140,478 B2
(45) Date of Patent: Nov. 28, 2006

(54) REVERSIBLY EXPANDABLE ENERGY ABSORBING ASSEMBLY UTILIZING ACTIVELY CONTROLLED AND ENGINEERED MATERIALS FOR IMPACT MANAGEMENT AND METHODS FOR OPERATING THE SAME

(75) Inventors: William Barvosa-Carter, Ventura, CA (US); Nancy L. Johnson, Northville, MI (US); Alan L. Browne, Grosse Pointe, MI (US)

(73) Assignee: General Motors Corporation, Detroit, MI (US)

( * ) Notice: Subject to any disclaimer, the term of this patent is extended or adjusted under 35 U.S.C. 154(b) by 0 days.

(21) Appl. No.: 10/918,653

(22) Filed: Aug. 13, 2004

(65) Prior Publication Data

US 2006/0032715 A1 Feb. 16, 2006

(51) Int. Cl.
*F16F 15/03* (2006.01)

(52) U.S. Cl. ..... 188/267; 188/267.1; 188/267.2; 280/753

(58) Field of Classification Search ..... 188/267, 188/267.1, 267.2; 296/187.05; 280/748, 280/753

See application file for complete search history.

(56) References Cited

U.S. PATENT DOCUMENTS

| | | | | |
|---|---|---|---|---|
| 1,331,359 | A | | 2/1920 | Parrott et al. |
| 1,936,389 | A | | 11/1933 | Hallquist |
| 3,588,158 | A | | 6/1971 | Ford et al. |
| 4,441,751 | A | | 4/1984 | Wesley |
| 4,890,877 | A | | 1/1990 | Ashtiani-Zarandi et al. |
| 5,098,124 | A | | 3/1992 | Breed et al. |
| 5,141,279 | A | | 8/1992 | Weller |
| 5,222,264 | A | | 6/1993 | Morry |
| 5,382,051 | A | | 1/1995 | Glance |
| 5,390,974 | A | * | 2/1995 | Theodorakakos ..... 296/146.9 |
| 5,452,957 | A | * | 9/1995 | Duggan ..... 384/99 |
| 5,454,589 | A | | 10/1995 | Bosio et al. |
| 5,458,366 | A | | 10/1995 | Hock et al. |
| 5,544,913 | A | | 8/1996 | Yamanishi et al. |
| 5,564,535 | A | | 10/1996 | Kanianthra |
| 5,746,442 | A | | 5/1998 | Hoyaukin |
| 5,794,975 | A | | 8/1998 | Nohr et al. |
| 5,839,756 | A | | 11/1998 | Schenck et al. |
| 6,012,764 | A | | 1/2000 | Seksaria et al. |
| 6,120,862 | A | | 9/2000 | Aouad et al. |
| 6,148,970 | A | | 11/2000 | Akad |
| 6,318,755 | B1 | | 11/2001 | Nusser et al. |
| 6,334,639 | B1 | | 1/2002 | Vives et al. |
| 6,536,818 | B1 | | 3/2003 | Moss |
| 6,547,280 | B1 | | 4/2003 | Ashmead |
| 6,550,850 | B1 | | 4/2003 | Laborie et al. |
| 6,910,714 | B1 | * | 6/2005 | Browne et al. ..... 280/753 |
| 2001/0028173 | A1 | | 10/2001 | Demarquilly et al. |
| 2001/0045762 | A1 | | 11/2001 | von Holst et al. |
| 2002/0017805 | A1 | | 2/2002 | Carroll, III et al. |
| 2002/0171067 | A1 | | 11/2002 | Jolly et al. |

(Continued)

FOREIGN PATENT DOCUMENTS

WO WO 03/101722 A1 12/2003

*Primary Examiner*—James McClellan
*Assistant Examiner*—Bradley T. King
(74) *Attorney, Agent, or Firm*—Kathryn A. Marra

(57) ABSTRACT

Reversibly expandable energy absorbing assemblies that utilize an actively controlled and engineering material to reversibly change a shear stress or a flexural modulus property. The actively controlled and engineering materials include magnetorheological fluids, electrorheological fluids, magnetorheological elastomers, and electrorheological elastomers. Methods of operating the energy absorbing assemblies are also disclosed.

14 Claims, 4 Drawing Sheets

U.S. PATENT DOCUMENTS

2003/0001372 A1 1/2003 Browne et al.
2003/0075953 A1 4/2003 Hirota et al.
2004/0126565 A1* 7/2004 Naganathan et al. ..... 428/323

* cited by examiner

REVERSIBLY EXPANDABLE ENERGY ABSORBING ASSEMBLY UTILIZING ACTIVELY CONTROLLED AND ENGINEERED MATERIALS FOR IMPACT MANAGEMENT AND METHODS FOR OPERATING THE SAME

BACKGROUND

This disclosure generally relates to an energy absorbing assembly and more particularly, to a reversibly expandable energy absorbing assembly for impact management utilizing actively controlled and engineered materials such as magnetorheological fluids and elastomers as well as electrorheological fluids and elastomers.

It is known in the prior art to provide various types of personal protection by the use of energy-absorbing devices, such as in helmets, vehicles, and the like. These products are generally designed to absorb a significant percentage of the energy from an impact. Within the vehicle, for example, various types of occupant protection devices may be employed for impact with structural body components such as door pillars, frames, headrails and the like. These components are typically made of steel tubing or steel channels that are welded together to form the structural cage or unitized body for the vehicle and may themselves absorb energy as the result of an impact. In addition, energy absorbers may also be placed over the door pillars, frames, headrails, and other parts of the vehicle to further protect the vehicle occupants during an impact event. Prior art approaches generally have used irreversibly crushable materials, such as metal, plastics or foams, irreversible air inflation devices, e.g. air bags and inflatable side curtains, rigid translation devices, e.g., extendable/retractable knee bolsters, and devices that can change the stroking forces, e.g., magnetorheological material based dampers.

BRIEF SUMMARY

Disclosed herein are reversibly expandable energy absorbing assemblies, interior vehicle surface compositions, and methods for operating the same. In one embodiment, the energy absorbing assembly comprises a rigid support structure comprising a fluid reservoir; a flexible covering engaged with the rigid support structure to define an expandable interior region; a plurality of elastic tubular structures disposed in the expandable interior region, wherein each one of the elastic tubular structures comprises an elongated hollow interior region, an open end in fluid communication with the fluid reservoir, and a closed end in contact with the flexible covering; a coil in electrical communication with a power supply, wherein the coil is wound about each one of the plurality of tubular structures; a magnetorheological fluid disposed in the fluid reservoir and the hollow interior region of the tubular structures, wherein the magnetorheological fluid is adapted to provide a change in fluid viscosity shear stress in response to a magnetic field provided by the coil; and means for selectively increasing a pressure within the fluid reservoir.

In another embodiment, the energy absorbing assembly comprises a rigid support structure comprising a fluid reservoir; a flexible covering engaged with the rigid support structure to define an expandable interior region; a plurality of elastic tubular or rectangular cross section structures disposed in the expandable interior region, wherein each one of the elastic tubular or rectangular cross section structures comprises an elongated hollow interior region, an open end in fluid communication with the fluid reservoir, and a closed end in contact with the flexible covering; a coaxial pair of electrodes in electrical communication with a power supply, wherein the coaxial pair of electrodes are in operative communication with each one of the plurality of tubular structures; an electrorheological fluid disposed in the fluid reservoir and the hollow interior region of the tubular structures, wherein the electrorheological fluid is adapted to provide a change in fluid shear stress in response to an applied electric field generated by the coaxial or parallel pair of electrodes; and means for selectively increasing a pressure within the fluid reservoir.

In yet another embodiment, the energy absorbing assembly comprises a flexible covering engaged with a rigid support structure to define an expandable interior region; a plurality of flexible cylindrical structures disposed in the expandable interior region, wherein each one of the flexible cylindrical structures comprises a magnetorheological elastomer; a coil in electrical communication with a power supply, wherein the coil is wound about each one of the plurality of flexible cylindrical structures; and means for selectively compressing the assembly into a stowed configuration and releasing the compressive means to provide a deployed configuration.

In still another embodiment, the energy absorbing assembly comprises a flexible covering engaged with a rigid support structure to define an expandable interior region; a plurality of flexible cylindrical or rectangular cross section structures disposed in the expandable interior region, wherein each one of the flexible cylindrical or rectangular cross section structures comprises an electrorheological elastomer; a coaxial or parallel pair of conductors in electrical communication with a power supply, wherein the conductors are in communication with each one of the plurality of flexible cylindrical structures; and means for selectively compressing the assembly into a stowed configuration and releasing the compressive means to provide a deployed configuration.

In another embodiment, the energy absorbing assembly comprises a flexible covering engaged with a rigid support structure to define an expandable interior region; a plurality of flexible cylindrical structures disposed in the expandable interior region, wherein each one of the flexible cylindrical structures comprises a magnetorheological elastomer or an elastic tube, jellyroll, or multiple coaxial geometry filled with an magnetorheological fluid; at least one permanent magnet placed between the bottom of the rigid support structure and the flexible cylindrical structure; a coil wound around the at least one permanent magnet in electrical communication with a power supply, wherein the coil is adapted to generate a second magnetic field opposing a first magnetic field of the permanent magnet; and means for selectively compressing the assembly into a stowed configuration and releasing the compressive means to provide a deployed configuration.

A method of operating an energy absorbing assembly comprises attaching the energy absorbing assembly to a rigid support structure including a fluid reservoir, wherein the energy absorbing assembly comprises a flexible covering engaged with the rigid support structure to define an expandable interior region; a plurality of elastic tubular structures disposed in the expandable interior region, wherein each one of the elastic tubular structures comprises an elongated hollow interior region, an open end in fluid communication with the fluid reservoir, and a closed end in contact with the flexible covering; a coil in electrical communication with a power supply, wherein the coil is wound about each one of the plurality of tubular structures; an actively controlled and engineered fluid disposed in the fluid reservoir and the hollow interior region of the tubular structures; and means for selectively increasing a pressure within the fluid reservoir; increasing a pressure within the fluid reservoir and expanding the expandable interior region; and applying a current to the coils and simultaneously increasing a shear stress of the actively controlled and engineered fluid and a yield stress of the plurality of tubular structures.

In another embodiment, the method of operating an energy absorbing assembly comprises attaching the energy absorbing assembly to a rigid support structure in a stowed position, wherein the energy absorbing assembly comprises a flexible covering engaged with the rigid support structure to define an expandable interior region; a plurality of flexible cylindrical structures disposed in the expandable interior region, wherein each one of the flexible cylindrical structures comprises a magnetorheological elastomer; a coil in electrical communication with a power supply, wherein the coil is wound about each one of the plurality of flexible cylindrical structures; and means for selectively compressing the assembly into a stowed configuration and releasing the compressive means to provide a deployed configuration; deploying the energy absorbing assembly by releasing the compressive means and expanding the expandable interior region; and applying a current to the coils and simultaneously increasing a flexural modulus property and a yield stress of the plurality of flexible cylindrical structures.

In another embodiment, a method of operating an energy absorbing assembly, comprises attaching the energy absorbing assembly to a rigid support structure in a stowed position, wherein the energy absorbing assembly comprises a flexible covering engaged with the rigid support structure to define an expandable interior region; a plurality of flexible cylindrical structures disposed in the expandable interior region, wherein each one of the flexible cylindrical structures comprises a electrorheological elastomer; a coaxial or parallel pair of conductors in electrical communication with a power supply, wherein the conductors are in electrical communication with each one of the plurality of flexible cylindrical structures; and means for selectively compressing the assembly into a stowed configuration and releasing the compressive means to provide a deployed configuration; deploying the energy absorbing assembly by-releasing the compressive means and expanding the expandable interior region; and applying power to the conductors and simultaneously increasing a flexural modulus property and a yield stress of the plurality of flexible cylindrical structures.

The above described and other features are exemplified by the following figures and detailed description.

BRIEF DESCRIPTION OF THE DRAWINGS

Referring now to the figures, which are exemplary embodiments and wherein like elements are numbered alike.

DETAILED DESCRIPTION

Disclosed herein are reversibly expandable energy absorbing assemblies for use in vehicle interior impact management that can be rapidly deployed to an expanded configuration so as to absorb kinetic energy associated with impact of an object against an interior surface. Advantageously, the energy absorbing assemblies are reversibly expandable and utilize actively controlled and engineered materials that maintain and increase the yield stress of an expanded configuration in the interior vehicle so as to provide absorption of impact energy. After deployment or an impact event, the energy absorbing assembly can recover its pre-deployed configuration by discontinuing an activation signal to the actively controlled and engineered materials. Discontinuing the activation signal decreases the shear stress or flexural modulus of the materials (depending on the particular embodiment), thereby permitting elastic relaxation of the energy absorbing assemblies to occur so as to restore the original pre-deployed shape. For some embodiments, suitable actively controlled and engineered materials include electrorheological and/or magnetorheological fluids and yield stress of the deployed device occurs by variably controlling the shear stress of the fluid. In alternative embodiments, suitable actively controlled and engineered materials include electrorheological and/or magnetorheological elastomers and yield stress of the device occurs by variably controlling the flexural modulus properties of the elastomers.

Figure 1:
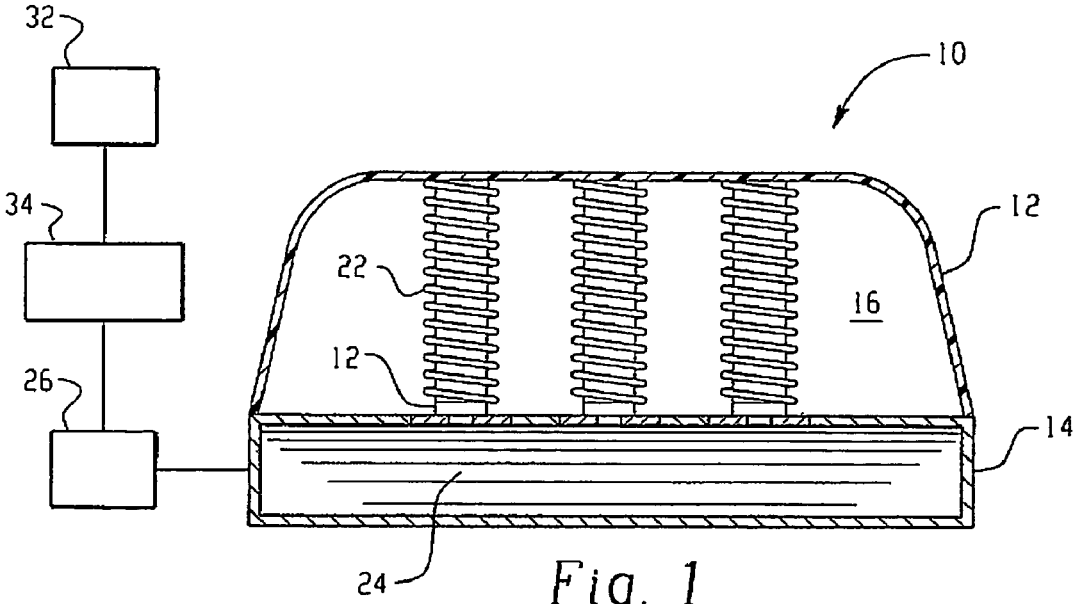
FIG. 1 is a schematic illustrating an energy absorbing assembly in a stowed or pre-deployed configuration in accordance with the present disclosure.
Figure 2:
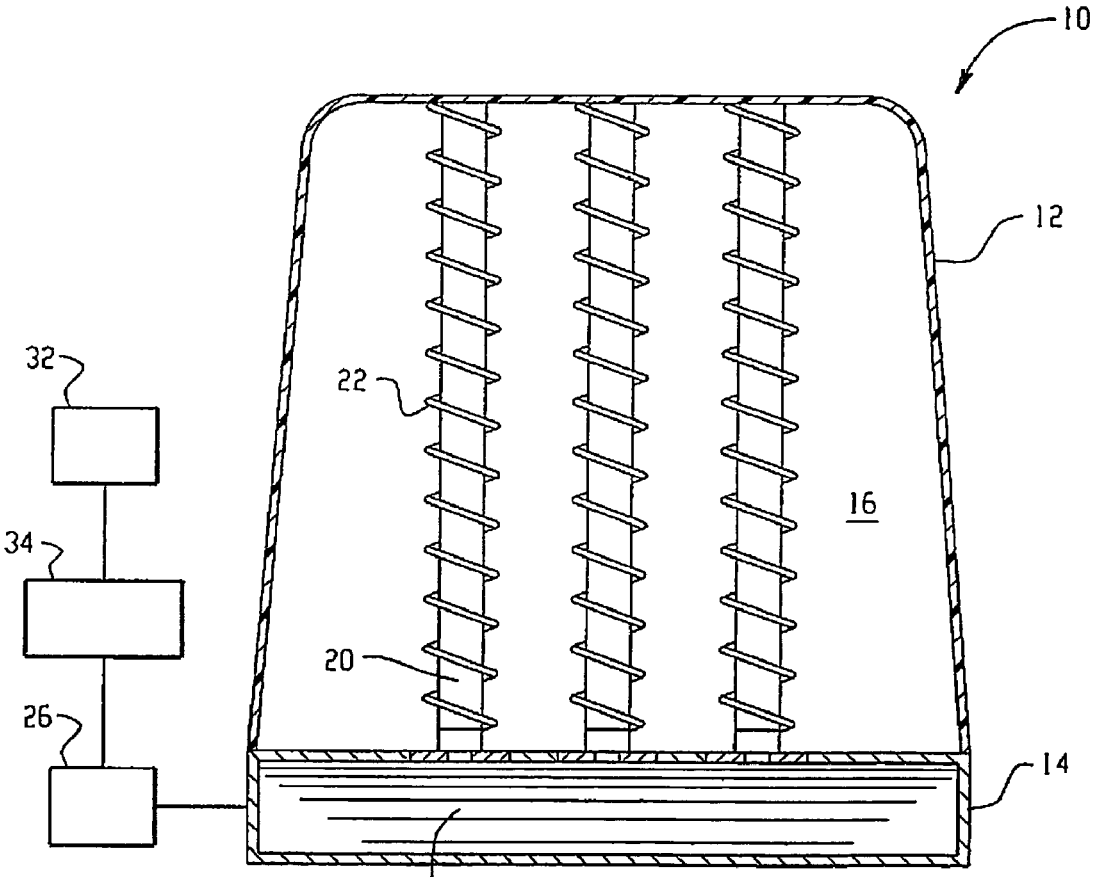
FIG. 2 is a schematic illustrating the energy absorbing assembly of FIG. 1 in deployed configuration.

As shown in FIGS. 1 and 2, an exemplary reversibly expandable energy absorbing assembly, generally indicated as 10, utilizing actively controlled and engineered materials comprises a flexible covering 12 attached to a rigid support structure 14. FIG. 1 illustrates the reversibly expandable energy absorbing assembly in a pre-deployed, i.e., a stowed or original configuration; and FIG. 2 illustrates the reversibly expandable energy absorbing assembly in a deployed or expanded configuration. The flexible covering 12 and the rigid support structure 14 define an expandable interior region 16. A plurality of elastic tubular structures 20 are disposed within the expandable interior region 16 and are positioned to outwardly extend the flexible covering 12 during operation, i.e., extend the flexible covering 12 away from the rigid support structure 14. The tubular structures can generally have any cross sectional shape, e.g., circular, oval, rectangular, and the like.

For magnetorheological materials, a conductive coil 22 is wound about each one of the tubular structures and is in electrical communication with a power supply (not shown) for energizing the coil. The pitch of the coils 22 will generally depend upon the diameter of the tubular structures, the magnetorheological fluid or elastomer composition, and the applied current provided by the power supply. The magnetorheological material is adapted to provide a change in fluid viscosity shear (fluid) stress or flexural modulus (elastomer) in response to an applied magnetic field provided by energizing the coil.

Figure 3:
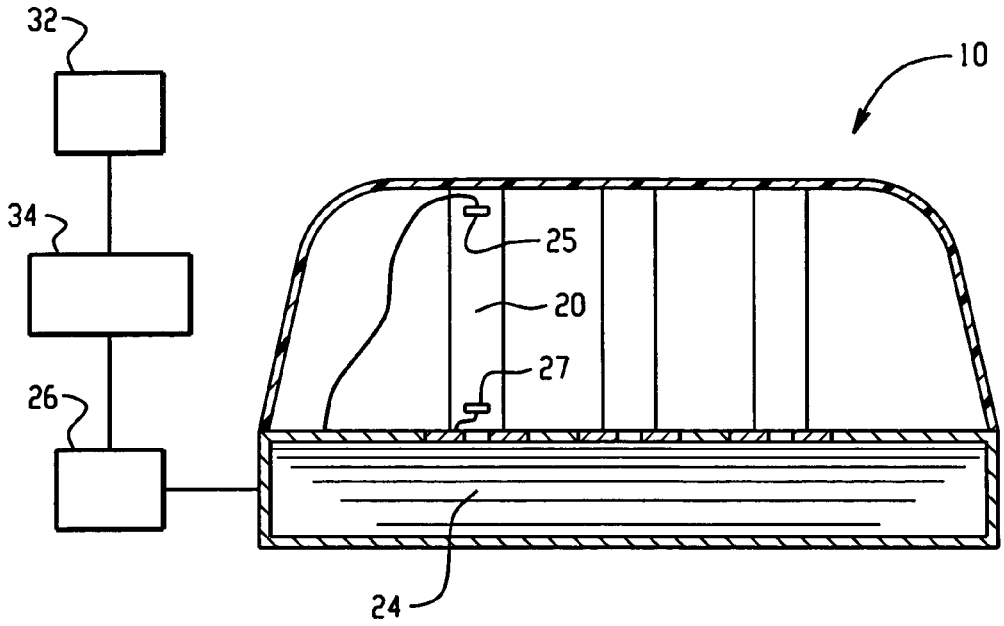
FIG. 3 is a schematic illustrating an energy absorbing assembly in accordance with another embodiment.

With regard to the use of electrorheological materials, a coaxial or parallel pair of electrodes 25, 27 are disposed in electrical communication with the power supply, wherein the coaxial or parallel pair of electrodes are in electrical communication with each one of the plurality of tubular structures. Alternatively a capacitor can be employed. An exemplary energy absorbing assembly 10 is shown in FIG. 3. The electrodes 25, 27 can be disposed within the interior region provided by the tubular structure 20 or externally in the case of elastomers. The electrorheological material is adapted to provide a change in shear stress (fluid) or flexural modulus (elastomer) in response to an electric field generated by the coaxial or parallel pair of electrodes.

The rigid support structure 14 includes a fluid reservoir 24 adapted for housing the actively controlled and engineered fluids. In the case of elastomers, the fluid does not have to be the actively controlled and engineered fluid. For example, if the tubular structures are formed of magnetorheological or electrorheological elastomers, the fluid can be a gas or a liquid. Likewise, a bladder disposed in the fluid reservoir or the like can be employed to selectively pressurize the tubular structures. In this embodiment, the fluid reservoir may include the actively controlled and engineered fluid, if desired.

Figure 4A:
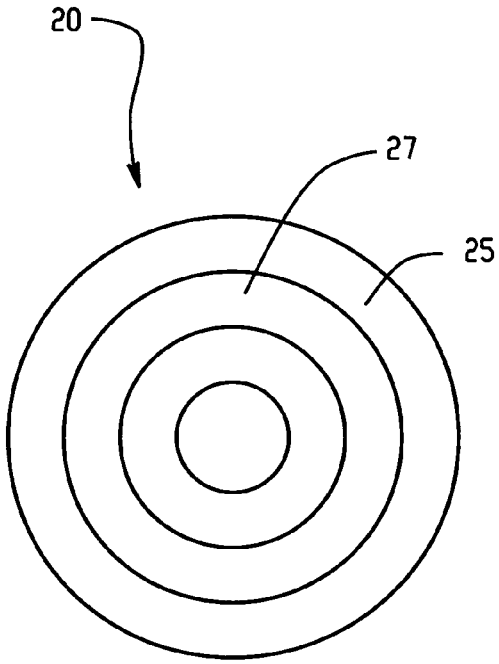
FIG. 4(*a, b*) is a plan view of a tubular structure for use in the energy absorbing assembly.
Figure 4B:
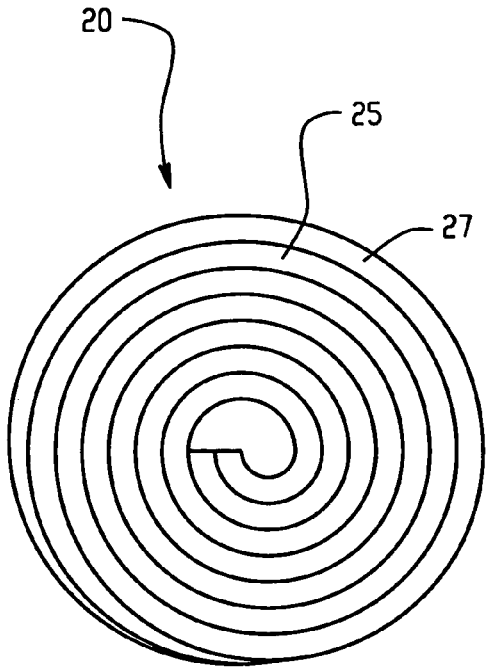

Each one of the elastic tubular structures 20 has an axially flexible, hollow, and elongated structure with opposing ends. One of the opposing ends is in open fluid communication with the fluid reservoir and the other end is closed ended and is preferably in contact with the flexible covering. Although the plurality of tubular structures 20 are shown perpendicularly oriented with respect to the rigid structure 14, the elastic tubular structures can be oriented at other angles for outwardly expanding the flexible covering 12 in the manner desired for the particular application. Alternatively, the elastic tubular structures 20 further comprise internal structures such as, for example, additional concentric tubes that form one or coaxial type geometries as shown in FIG. 4*a*. Optionally, the tubular structure 20 can take the form of a jelly roll as shown in FIG. 4*b*, wherein electrodes are formed on opposing surfaces that define the jelly roll. In this manner, the tubular structure 20 can have a concentric structure formed of one or more internal structures. The additional internal structures provides a means for increasing the surface area contact between the fluid and tube, thereby increasing friction and shear stress associated with tube collapse and increasing the effective yield stress.

A means 26 for selectively increasing a pressure within the fluid reservoir 24 is coupled to the rigid structure 14. Suitable means 26 for selectively increasing the pressure within the fluid reservoir 24 includes, but is not intended to be limited to, pneumatic motion, hydraulic piston motion, thermal expansion, release of a stored pressure source, and the like. The fluid reservoir 24 and the tubular structures 20 are filled with the desired actively controlled and engineered fluid.

During operation, the pressure within the fluid reservoir 24 is increased such that each one of the elastic tubular structures 20 elongates, thereby exerting a force against the flexible covering 12 and causing the flexible covering to expand (see FIG. 2). In the case of magnetorheological fluids, a current is then applied to coils 22 once the flexible covering 12 expands to a desired length dimension. Applying current to the coils increases the yield stress of the magnetorheological fluid within the tubular structures 20. In the case of electrorheological fluids, an electric field is generated between the electrodes, which causes an increase in yield shear stress. In either case, the elongated structure becomes fixed for the duration of the applied signal. The increased yield stress is preferably designed to resist any back-stresses due to the tubular structures as well as enable the structures to crush under an applied external force, thereby providing a mechanism for absorption of impact energy. It is also noted that the coils or other circumferential reinforcements (i.e., internal structure) within the walls of the flexible tubular structures effectively constrict the expansion of the tubular structures to a desired direction, e.g., against the flexible covering. Electrorheological and magnetorheological elastomers will function in a similar manner resulting in a change in the flexural modulus properties for the particular elastomeric material.

Optionally, in place of the coil 22 discussed above for use with MR materials, at least one permanent magnet is disposed between the rigid support structure 14 and the tubular structures 20. A coil (not shown) is wound about the at least one permanent magnet in electrical communication with the power supply. The coil may then be selectively activated to generate a magnetic field opposing the field of the permanent magnet. In this manner, a power off hold configuration can be maintained in the stowed and the deployed configurations. Moreover, in the stowed position, elastic energy can advantageously be stored in the tubular structure 20 and selectively used to assist during expansion, e.g., increase in fluid pressure.

In another optional embodiment, at least one permanent magnet is retractably positioned from the energy absorbing assembly. Retraction of the at least one permanent magnet can be by any means, including but not limited to a piston, solenoid, and the like. In still another embodiment, a magnetic shield is movably positioned between the applied magnetic field and the magnetorheological fluid or elastomer to selectively open or close the magnetic field.

Electrorheological (ER) and magnetorheological (MR) fluids are defined herein as a class of liquids having an apparent viscosity that can change reversibly when subjected to an electric field. ER fluids are most commonly colloidal suspensions of fine particles in non-conducting fluids. Under an applied electric field, electrorheological fluids and form fibrous structures that are parallel to the applied electric field and can increase in shear stress by a factor of up to $10^5$. The change in viscosity is generally proportional to the applied potential. In particular, under the application of a field of the order of 1–2 kV/mm an ER fluid can exhibit a solid-like behavior, such as the ability to transmit shear stress. This transformation from liquid-like to solid-like behavior can be very fast, of the order of 1 to 10 milliseconds and is reversible when the electric field is removed.

ER fluids are made by suspending particles in a liquid whose dielectric constant or conductivity is mismatched in order to create dipole particle interactions in the presence of an alternating current (ac) or direct current (dc) electric field. By filling the tubular structures 20 with the electrorheological fluid, the yield stress can be altered to provide increased absorption of kinetic energy from an impacting object. Any suitable electrorheological fluid can be employed. For example it is possible to use, for example, a fluid in which hydrous or semiconductive powders whose desired particle diameter and the like have been selected are contained in an oil or the like with an appropriate powder concentration. In this case, as dispersive powders, it is possible to use, for instance, polymethacrylate lithium, silica, polyacenquinone, carbonacenous powders, or the like.

MR fluids are generally suspensions of micrometer-sized, magnetically polarizable particles in oil or other liquids.

When a MR fluid is exposed to a magnetic field, the normally randomly oriented particles form chains of particles in the direction of the magnetic field lines. The particle chains increase the apparent shear stress (flow resistance) of the fluid. The stiffness of the structure is accomplished by changing the shear and compression/tension moduli of the MR fluid by varying the strength of the applied magnetic field. The MR fluids typically develop structure when exposed to a magnetic field in as little as a few milliseconds. Discontinuing the exposure of the MR fluid to the magnetic field reverses the process and the fluid returns to a lower shear stress state.

Suitable MR fluid materials include, but are not intended to be limited to, ferromagnetic or paramagnetic particles dispersed in a carrier fluid. Suitable magnetic particles include but are not intended to be limited to, soft or hard magnets; hematite; magnetite; magnetic material based on iron, nickel, and cobalt, alloys of the foregoing such as those including aluminum, silicon, cobalt, nickel, vanadium, molybdenum, chromium, tungsten, manganese and/or copper; iron oxides, including $Fe_2O_3$ and $Fe_3O_4$; iron nitride; iron carbide; carbonyl iron; nickel and alloys of nickel; cobalt and alloys of cobalt; chromium dioxide; stainless steel; silicon steel; and the like, or combinations comprising at least one of the foregoing. Examples of suitable particles include straight iron powders, reduced iron powders, iron oxide powder/straight iron powder mixtures and iron oxide powder/reduced iron powder mixtures. A preferred magnetic-responsive particulate is carbonyl iron, preferably, reduced carbonyl iron.

The particle size should be selected so that the particles exhibit multi-domain characteristics when subjected to a magnetic field. Diameter sizes for the particles can be less than or equal to about 1,000 micrometers, with less than or equal to about 500 micrometers preferred, and less than or equal to about 100 micrometers more preferred. Also preferred is a particle diameter of greater than or equal to about 0.1 micrometer, with, greater than or equal to about 0.5 more preferred, and greater than or equal to about 10 micrometers especially preferred. The particles are preferably present in an amount between about 5.0 to about 50 percent by volume of the total MR fluid composition.

Suitable carrier fluids include organic liquids, especially non-polar organic liquids. Examples include, but are not limited to, silicone oils; mineral oils; paraffin oils; silicone copolymers; white oils; hydraulic oils; transformer oils; halogenated organic liquids, such as chlorinated hydrocarbons, halogenated paraffins, perfluorinated polyethers and fluorinated hydrocarbons; diesters; polyoxyalkylenes; fluorinated silicones; cyanoalkyl siloxanes; glycols; synthetic hydrocarbon oils, including both unsaturated and saturated; and combinations comprising at least one of the foregoing fluids.

The viscosity of the carrier component can be less than or equal to about 100,000 centipoise, with less than or equal to about 10,000 centipoise preferred, and less than or equal to about 1,000 centipoise more preferred. Also preferred is a viscosity of greater than or equal to about 1 centipoise, with greater than or equal to about 250 centipoise preferred, and greater than or equal to about 500 centipoise especially preferred.

Aqueous carrier fluids may also be used, especially those comprising hydrophilic mineral clays such as bentonite or hectorite. The aqueous carrier fluid may comprise water or water comprising a small amount of polar, water-miscible organic solvents such as methanol, ethanol, propanol, dimethyl sulfoxide, dimethyl formamide, ethylene carbonate, propylene carbonate, acetone, tetrahydrofuran, diethyl ether, ethylene glycol, propylene glycol, and the like. The amount of polar organic solvents is less than or equal to about 5.0% by volume of the total MR fluid, and preferably less than or equal to about 3.0%. Also, the amount of polar organic solvents is preferably greater than or equal to about 0.1%, and more preferably greater than or equal to about 1.0% by volume of the total MR fluid. The pH of the aqueous carrier fluid is preferably less than or equal to about 13, and preferably less than or equal to about 9.0. Also, the pH of the aqueous carrier fluid is greater than or equal to about 5.0, and preferably greater than or equal to about 8.0.

Natural or synthetic bentonite or hectorite may be used. The amount of bentonite or hectorite in the MR fluid is less than or equal to about 10 percent by weight of the total MR fluid, preferably less than or equal to about 8.0 percent by weight, and more preferably less than or equal to about 6.0 percent by weight. Preferably, the bentonite or hectorite is present in greater than or equal to about 0.1 percent by weight, more preferably greater than or equal to about 1.0 percent by weight, and especially preferred greater than or equal to about 2.0 percent by weight of the total MR fluid.

Optional components in the MR fluid include clays, organoclays, carboxylate soaps, dispersants, corrosion inhibitors, lubricants, extreme pressure anti-wear additives, antioxidants, thixotropic agents and conventional suspension agents. Carboxylate soaps include ferrous oleate, ferrous naphthenate, ferrous stearate, aluminum di- and tri-stearate, lithium stearate, calcium stearate, zinc stearate and sodium stearate, and surfactants such as sulfonates, phosphate esters, stearic acid, glycerol monooleate, sorbitan sesquioleate, laurates, fatty acids, fatty alcohols, fluoroaliphatic polymeric esters, and titanate, aluminate and zirconate coupling agents and the like. Polyalkylene diols, such as polyethylene glycol, and partially esterified polyols can also be included.

In an alternative embodiment, the energy absorbing assembly comprises electrorheological elastomers or magnetorheological elastomers. Suitable actively controlled and engineered elastomer materials include, but are not intended to be limited to, an elastic polymer matrix comprising a suspension of ferromagnetic or paramagnetic particles, wherein the particles are described above. Suitable polymer matrices include, but are not intended to be limited to, poly-alpha-olefins, natural rubber, silicone, polybutadiene, polyethylene, polyisoprene, and the like.

Figure 5:
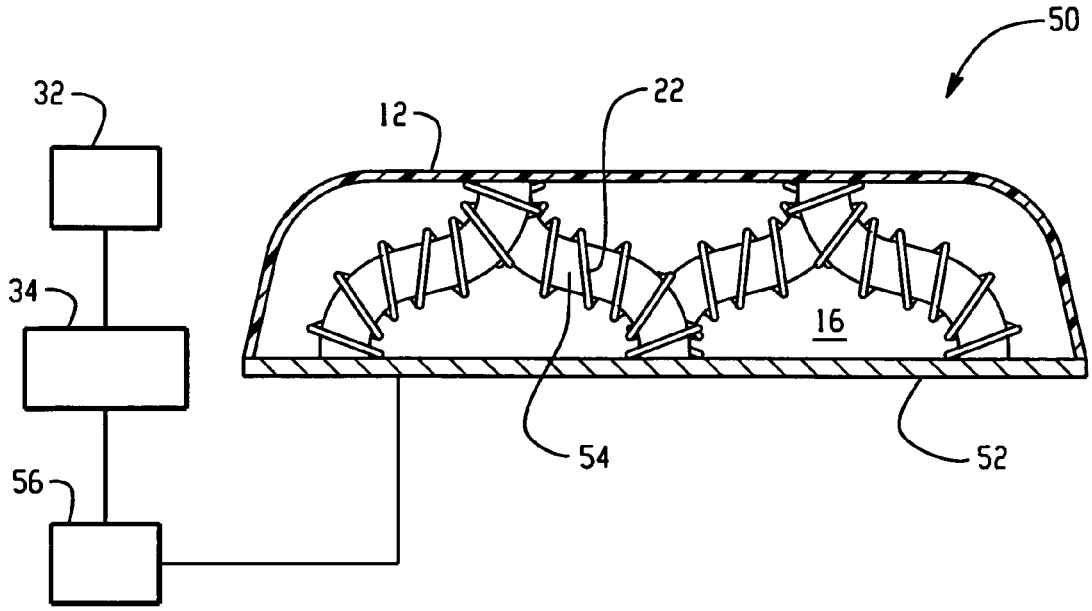
FIG. 5 is a schematic illustrating an energy absorbing assembly in a stowed or pre-deployed configuration in accordance with another embodiment of the present disclosure.
Figure 6:
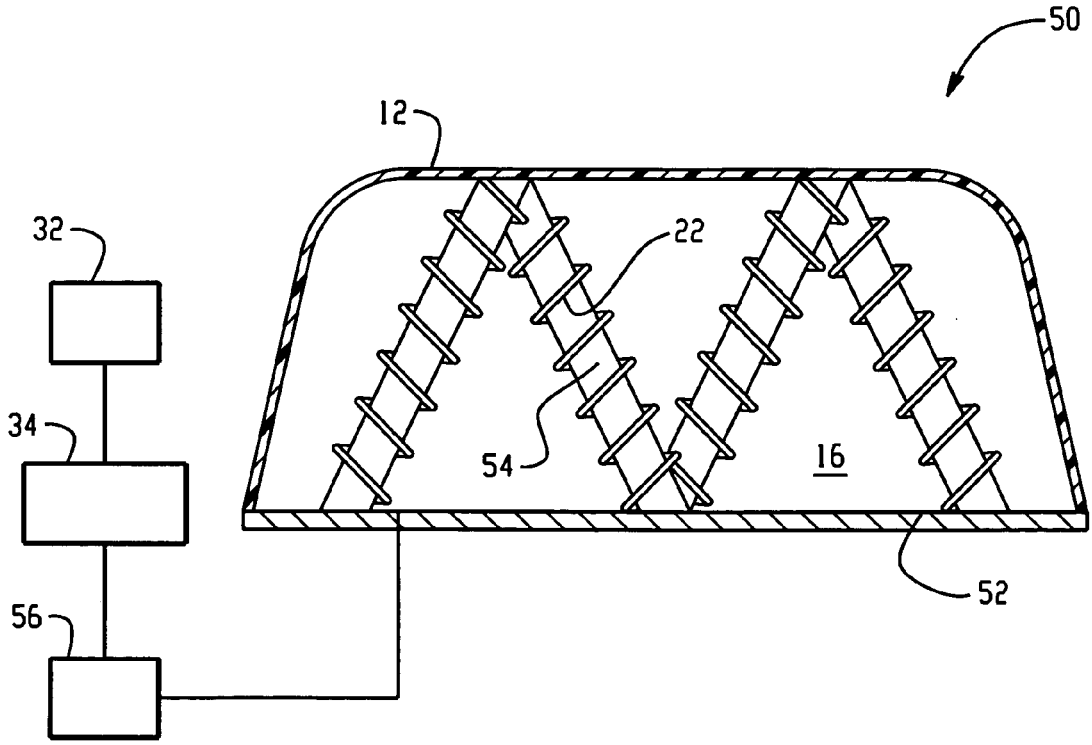
FIG. 6 is a schematic illustrating the energy absorbing assembly of FIG. 3 in a deployed configuration.

FIGS. 5 and 6 illustrate an exemplary energy absorbing assembly 50 utilizing the magnetorheological elastomers, in a predeployed and a deployed state, respectively. The assembly 50 includes the flexible covering 20 as previously described and a rigid support structure 52 to define the expandable interior region 16. The rigid support structure 52 for use with the elastomers does not require a fluid reservoir as discussed with regard to the previous embodiments. Rather, the rigid support structure 52 can be any rigid planar surface within the interior of a vehicle. A plurality of flexible cylindrical structures 54 formed of MR elastomers are affixed to the rigid support structure. The flexible cylindrical structures 54 can have solid or hollow interior regions depending on the desired application. As shown, each one of the flexible cylindrical structures are preferably disposed at acute angles relative to the planar surface of the rigid support structure having its distal end connected to a distal end of an adjacent cylindrical structure to form a scissor-like network of the elastomers on the rigid support structure. Although a scissor-like network is shown, various other configurations are contemplated that would provide outward expansion of the flexible covering 12 during deployment, e.g., trusses, lattices, cages, and the like. A coil 22 is wound about each one of the cylindrical structures at a pitch effective to variably control the yield stress of the magnetorheological elastomers that form the cylindrical structures.

During operation, the assembly 50 is stowed in a reduced volume state, which may require means 56 for mechanically pressing and restraining the assembly by any suitable means or by applying a constant vacuum pressure. For deployment, the mechanical restraint or vacuum pressure is released to permit flexible cylindrical structures 54 to expand to its unstressed configuration, which is a shape that is substantially straight and free of curvatures. In doing so, the flexible cylindrical structures 54 exert a force on the flexible covering 12 causing it to expand. A current is then applied to the coils to increase the yield stress of the flexible cylindrical structures 54. In this manner, absorption of impact energy can be variably controlled by the varying of the applied potential to the coils. To restow the structure, the current is discontinued and the assembly 50 recompressed either mechanically or by vacuum pressure and subsequently restrained. As such, the flexible cylindrical structures are preferably designed to permit compression during non-use and provide sufficient expansion when the means for compression is removed.

The energy absorbing assemblies 10, 50 described above preferably include a sensor 32 and a controller 34 in operative communication with the means for increasing the pressure as in assembly 10 or the means 56 for compressing and restraining the assembly to provide a stowed configuration as in assembly 50.

The sensor 32 is preferably configured to provide pre-impact information to the controller 34, which then actuates the energy absorbing assembly 10 or 50 under pre-programmed conditions defined by an algorithm or the like. Note that the shear stress/stiffness of the MR or ER fluids/elastomers is adjustable (i.e., tunable) based on the strength of the field that is applied. Thus, based on the input from sensors 32, the controller 34 can cause the appropriate magnitude of field to be applied for the particular impending impact scenario. For example, the stiffness could be reduced by 50% for the case of impact of a child's head as compared to that of an adult, thereby exposing both to the same level of deceleration. In this manner, the assemblies 10 or 50 can be used to anticipate an event such as an impact with an object and provide absorption of the kinetic energy associated with an occupant within the vehicle as a result of the impact. In the event a subsequent impact is not realized, the energy absorbing assembly 10 or 50 reverts back to its original shape in the manner previously discussed for each embodiment. The illustrated energy absorbing assemblies 10, 50 are exemplary only and are not intended to be limited to any particular shape, size, configuration, or the like.

Suitable magnetic field strengths for tubular structures 20 comprised of MR or ER fluids and/or elastomers generally range from about 0 to about 1 Tesla (T). Moreover, yield stress of the tubular structures 20, 54 can be variably controlled as may be desired depending on the severity of the impact.

For impact energy management, it is preferred that the total expansion times be relatively rapid. Preferably, the energy absorbing assembly is configured to be fully expanded within about 50 milliseconds (msec) or less. Preferably, the energy absorbing assembly provides a volume expansion greater than 50 percent, with a volume expansion greater than 100 percent more preferred, and a volume expansion of about 200 to about 400 percent even more preferred.

The flexible covering 12 is preferably fabricated from a material that is elastic (flexible) to the limits of the assembly expansion so that it can return to its original geometry. As such, suitable materials include elastomers such as styrene butadiene rubber, polyurethanes, polyisoprene, neoprene, chlorosulfonated polystyrenes, various elastic fabrics, and the like. Optionally, the flexible covering 12 can be fabricated with a relatively inflexible, non-elastic upper surface attached to elastic sidewalls to permit an effective amount of outward expansion. Still further, in those embodiments in which the interior region need not be pressurized to effect deployment, no sidewalls are needed and tethers or a tether like structure may be used to secure the covering to the rigid support structure and define the expandable interior region therebetween. Other materials suitable for use as a flexible cover 12 will be apparent to those skilled in the art in view of this disclosure. Preferably, the material chosen for the flexible cover accommodates reversible strains of at least about 400 percent, with strains of about 200 to about 400 percent more preferred. The flexible covering 12 can be decoratively patterned or, optionally, an outer decorative covering (not shown) can be provided in sliding engagement over the flexible covering 12, e.g., a stretchable fabric or the like.

Figure 7:
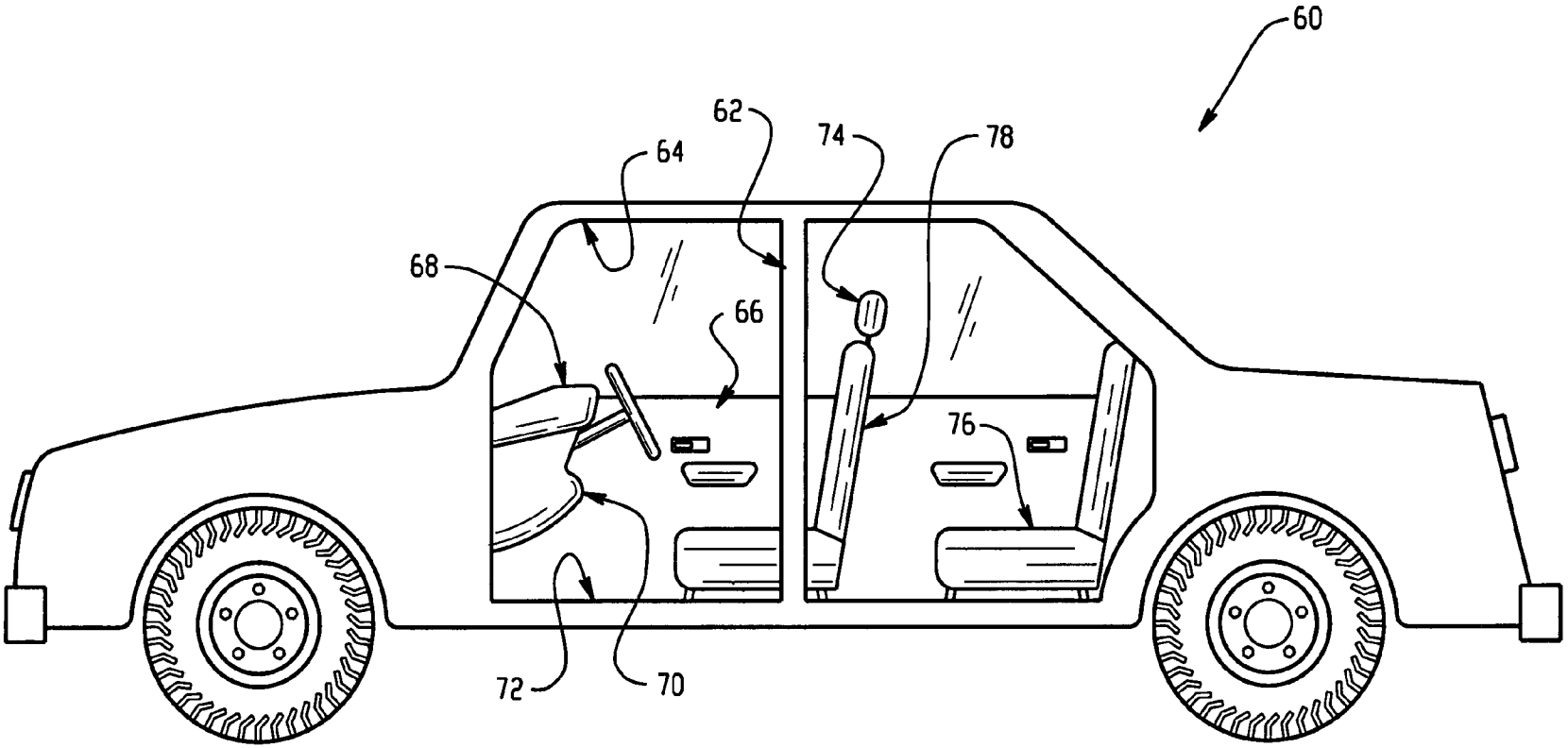
FIG. 7 is a side perspective view of a vehicle illustrating various support structures suitable for employing the energy absorbing assembly.

The energy absorbing assemblies 10, 50 can be used to replace conventional padded interior surfaces shown in FIG. 7 in a vehicle 60. For example, the energy absorbing assemblies 10, 50 can be used for the door pillars 62, the header 64, the door interiors 66, the dashboard 68, the sun visors, the center console, the instrument panel, the armrests, the knee bolsters 70, and other areas such as under the carpet on the vehicle floor 72, in the headrest 74 of the seat, the seat 76 itself, the seat backs 78, or like surfaces where absorption of kinetic energy caused by impact of an object with the surface is desired and/or proper positioning of an occupant is desired during an impact. For example, locating the energy absorbing assemblies 10, 50 under the carpet can be used to assist the positioning of an occupant's knees with respect to the knee bolster. In the seat area, the energy absorbing assembly can be strategically positioned to provide stiffening at an edge of the seat 76 to provide anti-submarining properties and help keep an occupant from sliding forward in the event of an impact. Other areas of the vehicle 60, such as the door pillars 62, can provide energy absorption properties to the occupant in the event of the impact, thereby decreasing the forces associated with an impact to the occupant.

While the disclosure has been described with reference to an exemplary embodiment, it will be understood by those skilled in the art that various changes may be made and equivalents may be substituted for elements thereof without departing from the scope of the disclosure. In addition, many modifications may be made to adapt a particular situation or material to the teachings of the disclosure without departing from the essential scope thereof. Therefore, it is intended that the disclosure not be limited to the particular embodiment disclosed as the best mode contemplated for carrying out this disclosure, but that the disclosure will include all embodiments falling within the scope of the appended claims.

The invention claimed is:

1. An energy absorbing assembly, comprising:

a rigid support structure comprising a fluid reservoir;

a flexible covering engaged with the rigid support structure to define an expandable interior region;

a plurality of elastic tubular structures disposed in the expandable interior region, wherein each one of the elastic tubular structures comprises an elongated hollow interior region, an open end in fluid communication with the fluid reservoir, and a closed end in contact with the flexible covering;

coils in electrical communication with a power supply, wherein each one of the coils is wound about a selected one of the plurality of tubular structures;

a magnetorheological fluid disposed in the fluid reservoir and the hollow interior region of the tubular structures, wherein the magnetorheological fluid is adapted to provide a change in fluid viscosity shear stress in response to a magnetic field provided by the coils; and means for selectively increasing a pressure within the fluid reservoir.

2. The energy absorbing assembly of claim 1, wherein the magnetorheological fluid comprises ferromagnetic or paramagnetic particles dispersed in a carrier fluid, wherein the particles are selected from the group consisting of iron, iron alloys, iron oxides, iron nitride, iron carbide, carbonyl iron, nickel, cobalt, chromium dioxide, stainless steel, silicon steel, and combinations comprising at least one of the foregoing; and wherein the carrier fluid is selected from the group consisting of silicone oils, mineral oils, paraffin oils, silicone copolymers, white oils, hydraulic oils, transformer oils, halogenated paraffins, perfluorinated polyethers and fluorinated hydrocarbons, diesters, polyoxyalkylenes, fluorinated silicones, cyanoalkyl siloxanes, glycols, synthetic hydrocarbon oils, and combinations comprising at least one of the foregoing fluids.

3. The energy absorbing assembly of claim 1, further comprising a crash sensor in electrical communication with a controller, wherein the controller is in operative communication with the means for selectively increasing the pressure within the fluid reservoir.

4. The energy absorbing assembly of claim 1, wherein the magnetorheological fluid comprises a magnetic material based on iron, nickel, cobalt, or combinations comprising at least one of the foregoing, and a carrier fluid.

5. The energy absorbing assembly of claim 1, wherein the rigid support structure forms a portion of a vehicle door pillar, a vehicle header, a vehicle door interior, a vehicle dashboard, a sun visor, an armrest, a vehicle knee bolster, a vehicle floor, a vehicle headrest, a vehicle seat, a center console, an instrument panel, or a vehicle seat back.

6. The energy absorbing assembly of claim 1, wherein the assembly defines an interior vehicle surface.

7. The energy absorbing assembly of claim 1, wherein the assembly forms a door pillar surface, a headrest surface, a floor surface, a seat surface, a dashboard surface, a center console, an instrument panel, a steering wheel surface, a door surface, a ceiling surface, or a combination thereof.

8. The energy absorbing assembly of claim 1, wherein each one of the elastic tubular structures comprises a jellyroll or a multiple coaxial cylindrical geometry and the magnetorheological fluid is disposed in the fluid reservoir and between the surfaces of the jellyroll or the multiple coaxial cylindrical geometry.

9. A method of operating an energy absorbing assembly, comprising:

attaching the energy absorbing assembly to a rigid support structure including a fluid reservoir, wherein the energy absorbing assembly comprises a flexible covering engaged with the rigid support structure to define an expandable interior region; a plurality of elastic tubular structures disposed in the expandable interior region, wherein each one of the elastic tubular structures comprises an elongated hollow interior region, an open end in fluid communication with the fluid reservoir, and a closed end in contact with the flexible covering; coils in electrical communication with a power supply, wherein each one of the coils is wound about a selected one of the plurality of tubular structures; an actively controlled and engineered fluid disposed in the fluid reservoir and the hollow interior region of the tubular structures; and means for selectively increasing a pressure within the fluid reservoir;

increasing a pressure within the fluid reservoir and expanding the expandable interior region; and applying a current to the coils and simultaneously increasing a viscosity of the actively controlled and engineered fluid and a yield stress of the plurality of tubular structures.

10. The method of operating the energy absorbing assembly of claim 9, wherein the actively controlled and engineered fluid is selected from the group consisting of magnetorheological fluids and electrorheological fluids.

11. The method of operating the energy absorbing assembly of claim 9, further comprising sensing an impact prior to increasing the pressure within the fluid reservoir.

12. The method of operating the energy absorbing assembly of claim 9, further comprising releasing the increased pressure; and discontinuing the current to the coils to simultaneously cause a reduction in the shear stress of the actively controlled and engineered fluid and the yield stress of the plurality of tubular structures.

13. The method of operating the energy absorbing assembly of claim 9, wherein the actively controlled and engineered fluid is a magnetorheological fluid and the coils are in magnetic communication with the magnetorheological fluid.

14. The method of operating the energy absorbing assembly of claim 9, wherein each one of the elastic tubular structures comprises a jellyroll or multiple coaxial cylinder geometry, wherein the actively controlled and engineered fluid is disposed in the fluid reservoir and between the surfaces of the jellyroll or multiple coaxial cylinder geometry.

* * * * *